United States Patent [19]

Bertoldo

[11] Patent Number: 4,955,114

[45] Date of Patent: Sep. 11, 1990

[54] APPARATUS FOR CAUSING THE SHRINKING OF A CLOTH

[75] Inventor: Franco Bertoldo, Brogliano, Italy

[73] Assignee: Sperotto Rimar S.p.A., Thiene, Italy

[21] Appl. No.: 417,582

[22] Filed: Oct. 5, 1989

[30] Foreign Application Priority Data

Oct. 14, 1988 [IT] Italy ..... 22304 A/88

[51] Int. Cl.[5] ..... D06C 21/00

[52] U.S. Cl. ..... 26/18.6

[58] Field of Search ..... 28/18.5, 18.6

[56] References Cited

U.S. PATENT DOCUMENTS 4,156,955 6/1979 Joy ..... 26/18.6

4,446,606 5/1984 Lawrence et al. ..... 26/18.6

FOREIGN PATENT DOCUMENTS 494132 6/1950 Belgium ..... 26/18.6

*Primary Examiner*—Werner H. Schroeder

*Assistant Examiner*—Bradley Kurtz DeSandro

*Attorney, Agent, or Firm*—Charles E. Brown; Charles A. Brown

[57] ABSTRACT

An apparatus for causing the shrinking of a cloth, comprising a revolving drum, an endless-loop belt wound around said drum, a return roller which causes said endless belt to adhere to said drum, a flexible sheet partially winding around the belt and the return roller and entering a portion between said drum and said belt wound around the drum, and guide means for guiding the cloth to be processed, in which apparatus the ratio of the diameter of the return roller to the thickness of the belt is such as to cause an improved compacting effect on the cloth.

3 Claims, 1 Drawing Sheet

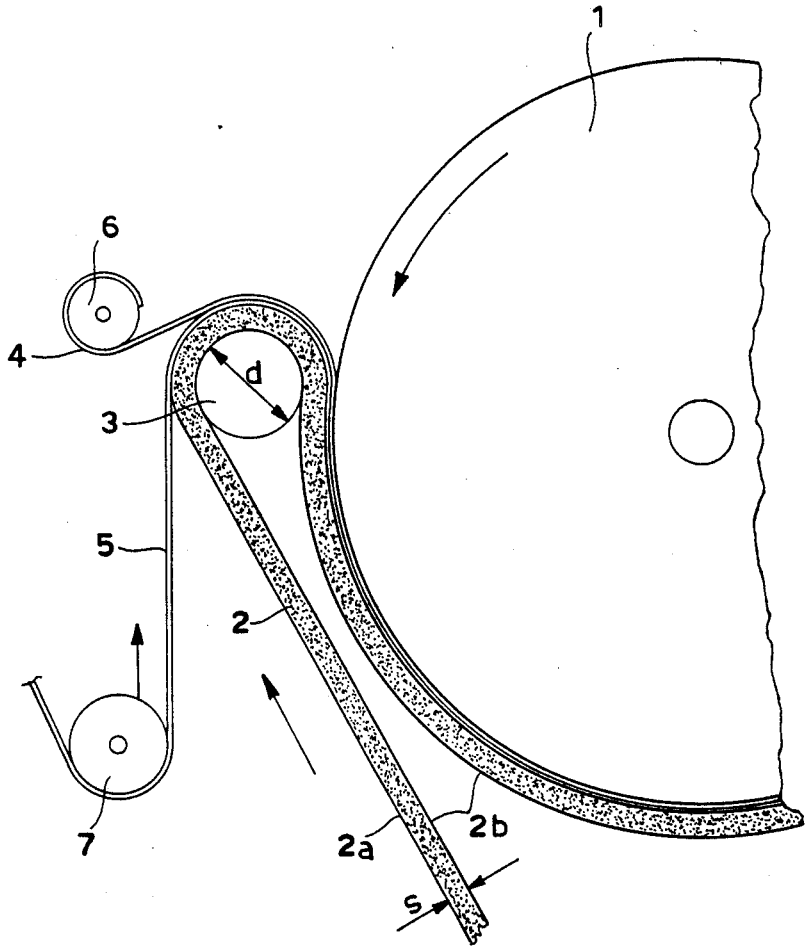
1
6
4
d
3
5
2
7
2a
2b
s

APPARATUS FOR CAUSING THE SHRINKING OF A CLOTH

A process for causing the shrinking of a cloth by compression or by compacting is known, which is carried out by means of an apparatus essentially comprising a heated drum revolving around its own longitudinal axis, around which an endless-loop belt made from a textile material, in particular of the type of needled felt, is wound with a first one of its faces, a return roller for said belt so positioned as to cause said first face of said endless belt to adhere to said drum, and a flexible sheet—made from fiberglass coated with a Teflon layer, and denominated "shoe"—partially winding around said first face of said belt in the region in which the belt, with its second face, is wound around the return roller, and subsequently extends entering a portion in which said belt is wound around said drum.

In such a kind of apparatus, the first face of the belt undergoes a stretching in the region in which the belt is wound with its second face around the return roller, whilst in the region in which said belt is wound around said drum, said first face thereof undergoes a compression. (see U.S. Pat. No. 4,156,955).

The textile material to be processed, which is in the form of a continuous cloth, is deposited on the first face of the belt immediately before said belt is wound by the "shoe" around the same return roller around which the belt returns, thus entering the region between the "shoe" and the belt, and subsequently entering the region in which the "shoe" and the belt are wound around the drum. The cloth is thus pinched between the "shoe" and said first face of said belt in the region in which said first face is stretched and in the subsequent region, in which the first face of said belt is compressed, the cloth is obliged to follow it, being thus compacted.

The purpose of the present invention is of providing an apparatus of the type as hereinabove defined, which is capable of producing compacting effects on the cloths, which are considerably better than as obtainable by means of the apparatuses known from the prior art.

In order to achieve said purpose, the phenomena and the mechanism have been investigated in detail, which is such apparatuses lead to the compacting of the processed cloths.

As above said, for the purposes of the compacting of the cloth, substantially two factors are decisive: the stretching, and the following compression of the first face of the belt, which, in the region is which said belt is wound around the return roller is its outer face, and then, in the region in which the belt is wound around the drum, becomes its inner face; as well as the pinching of the cloth to be processed between a "shoe" and said first face of the belt in the regions in which said face is first stretched and then compressed.

As regards the phenomena of stretching and of compression of said first face of the belt, we were able to observe that they are caused by the higher peripheral speed of said face in the region in which the belt is wound around the return roller, than the peripheral speed in the region in which the belt is wound around the drum.

We were able to verify that such a difference of speed essentially depends on the existing ratio of the diameter of the belt return roller, to the thickness of the same belt.

In other words, the higher the thickness of the belt, or the smaller the diameter of the return roller, the higher is said speed difference. Inasmuch as the higher the difference between the peripheral speeds of said belt face in said above specified two regions, the higher is the compression of said first face of the belt—and, consequently, the compacting of the cloth, which is obliged to follow it—, and inasmuch as this speed difference is mainly a function of the ratio of the diameter of the return roller to the thickness of the belt, we concluded that keeping the value of said ratio as small as possible, is advantageous.

In the apparatuses known from the prior art, the importance of such a ratio for the purposes of the obtainable compacting result does not result to be underlined, and in the existing practical embodiments of said apparatuses the ratio of the diameter of the return roller to the thickness of the belt is never lower than 5.5, with relatively poor effects of cloth compacting, in particular never higher than 10–12%, being obtained.

According to the present invention, providing an apparatus for causing the shrinking of a cloth is proposed now, in which the ratio of the diameter of the return roller to the thickness of the belt is lower than 5.5, and in particular is comprised within the range of from 5.5 to 1.5, so that considerably better effects of cloth compacting are obtained, in particular compacting effects being obtained, which in particular are comprised within the range of from 10% to 30%.

The present invention is disclosed in greater detail in the following by referring to the hereto attached drawing, the single FIGURE of which shows a schematic view of the basic portion of the apparatus.

All of the parts which are not either specifically illustrated or disclosed, can be accomplished according to traditional techniques, e.g., as it results from above cited U.S. Pat. No. 4,156,955.

The apparatus comprises a heated steel drum 1, revolving around its own longitudinal axis, around which drum an endless-loop belt 2 is wound with its first face 2*a*, which belt is made from a textile material, in particular of the type of needled felts, and has a thickness s of, e.g., 23 mm. Said belt 2 is at least partially wound with its second face 2*b* around a return roller 3, made from steel, revolving around its own longitudinal axis, having a diameter of, e.g., 92 mm, and positioned in the nearby of the revolving drum 1 so as to accompany the first face 2*a* of said belt 2 into contact with said drum 1.

In the nearby of the return roller 3 a flexible sheet 4—denominated "shoe"—is placed, which is fastened in 6 and is at least partially wound around the first face 2*a* of the belt 2 in the region in which said belt 2 is wound around said return roller 3 with its second face 2*b*. The flexible sheet 4 extends then, at least partially, into the room existing between the first face 2*a* of the belt 2 and the drum 1, and has a width equal to the width of said belt 2. A textile material in the form of a continuous cloth 5 is fed through a roller 7 to deposit onto the first face 2*a* of the belt 2 in the region in which said belt 2 is wound around the return roller 3, with said cloth being hence guided to run through the flexible sheet 4 and the first face 2*a* of said belt 2, in order to subsequently continue through the region interposed between the flexible sheet 4 and the first face 2*a* of the belt 2 in the portion in which this latter is wound around the drum 1. The face 2*a* of the belt 2, in the region in which it is wound around the return roller 3, undergoes a stretching relatively to the same face of belt 2 in the foregoing region, in which said belt 2 is not wound around said return roller 3, and said face 2a undergoes a compression in the subsequent portion in which the belt 2 is wound around the drum 1 and in which said face 2a, which formerly was the outer face, becomes the inner face.

Inasmuch as the cloth is pinched by the sheet 4 onto the face 2a of the belt 2 in the region in which said face 2a is stretched, and is thus obliged to follow it in its subsequent compression in the portion in which said belt 2 is wound around the drum 1, said cloth 5 undergoes a compacting. The ratio of the thickness s of the belt 2 to the diameter d of the return roller 3 is the basic parameter in order to determine the extent of compacting of cloth 5. With the hereinabove stated exemplifying dimensions (thickness s=23 mm and diameter d=92 mm), said ratio of d/s is 4, and is hence lower than as provided in the traditional apparatuses according to the prior art.

Of course, the reduction in return roller diameter and the increase in belt thickness are subject to practical limits dictated, on one hand, by the required indispensable characteristics of mechanical strength and mechanical stability of the return roller, and, on the other hand, by the resistance of the belt made from the felt-type textile material, in order to prevent it from undergoing an excessive and rapid wear owing to yielding.

In a practical test, a circular knitted cloth in open form, of 100% cotton fibre and with double needle bed jersey/roving interlacing, usually denominated "plush", of 192 cm of width and weighing 315 g/m$^2$ was submitted to shrinking by compression with the hereinabove disclosed apparatus, with a compacting of 19% in the longitudinal direction being obtained.

In the cycle of finishing of knitted cloths, said cloths are often submitted to operations of processing under tension, which cause a longitudinal elongation and a corresponding transversal shrinking thereof, as compared to their original dimensions.

In order to recover, at least to a partial extent, said longitudinal elongation of the cloth, an operation—denominated "tentering", i.e., of treatment of the cloth on a "tenter frame"—is usually carried out, during which said cloth is stretched crosswise, so as to cause it to undergo a corresponding longitudinal decrease in length. After said step, the cloth can be further stabilized by means of the treatment in an apparatus capable of causing it to shrink by compression and compacting, of such a type as hereinabove disclosed.

The main advantage offered by such an apparatus according to the present invention, capable of giving the cloth a compacting of the order of 20% and more, as compared to those machines which only cause compacting values of round 10%, results to be the possibility of recovering by means of one single pass, all of the elongation undergone by the cloth, with the preliminary tentering step being hence avoided, which results in considerable savings in time and labour, with positive outcomes as regards the processing costs.

I claim:

1. Apparatus for causing the shrinking of a cloth, comprising a drum revolving around its own longitudinal axis, an endless-loop belt made from a textile material of the type of needled felts wound with a first one of its faces around said revolving drum, a return roller for said belt so positioned as to cause said first face of said endless belt to adhere to said drum, a flexible sheer partially winding around said first face of said belt in the region in which the belt, with its second face, is wound around the return roller, and which subsequently extends entering a portion in which said belt is wound around said drum, and guide means for guiding the cloth to be processed and deposit it onto said first face of said belt immediately before said belt is wound by said flexible sheet around the belt return roller, so as to cause the cloth to enter the room existing between said flexible sheet and the first face of said belt, characterized in that the ratio of the diameter of said return roller to the thickness of the belt is lower than 5.5.

2. Apparatus according to claim 1, characterized in that said ratio is comprised within the range of from 5.5 to 1.5.

3. Apparatus according to claim 2, characterized in that said ratio is 4.

* * * * *